US009339851B2

(12) United States Patent
Blair et al.

(10) Patent No.: US 9,339,851 B2
(45) Date of Patent: May 17, 2016

(54) ROBOTIC CLEANING SYSTEM

(71) Applicant: Caterpillar Inc., Peoria, IL (US)

(72) Inventors: William L. Blair, Peoria, IL (US); James McGrew, Morton, IL (US); Adam Barriger, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 776 days.

(21) Appl. No.: 13/676,499

(22) Filed: Nov. 14, 2012

(65) Prior Publication Data

US 2014/0130826 A1 May 15, 2014

(51) Int. Cl.
*B08B 1/00* (2006.01)
*B08B 13/00* (2006.01)

(52) U.S. Cl.
CPC . *B08B 1/006* (2013.01); *B08B 1/00* (2013.01); *B08B 1/008* (2013.01); *B08B 13/00* (2013.01)

(58) Field of Classification Search
CPC ..... B08B 1/00; B08B 1/001; B08B 1/006; B08B 1/008; B08B 1/02; B08B 3/00
See application file for complete search history.

(56) References Cited

U.S. PATENT DOCUMENTS 6,618,896 B1 9/2003 Nerger
6,671,918 B2 * 1/2004 Matsuno ..... B08B 1/008 15/102
6,905,551 B2 * 6/2005 Davis ..... B08B 1/00 134/18
2011/0197918 A1 8/2011 Kasper

* cited by examiner

*Primary Examiner* — Laura C Guidotti

(57) ABSTRACT

A system for cleaning a component of a machine is provided. The system includes a cleaning head having a first reel and a second reel to store a cloth. The cleaning head also includes a first idler and a second idler placed in a spaced apart arrangement. The first idler and the second idler are configured to receive the cloth from the first reel. The second reel is configured to store the cloth received from the first idler and the second idler. A spray nozzle is provided to spray a cleaning agent on to the cloth. A robotic arm is attached to the cleaning head. A controller is configured to position the cleaning head relative to the component, activate a movement of the first reel and the second reel to effectuate a dry cleaning cycle, and selectively activate the spray nozzle to effectuate a wet cleaning cycle.

8 Claims, 5 Drawing Sheets

ROBOTIC CLEANING SYSTEM

TECHNICAL FIELD

The present disclosure relates to an automated system and more particularly to an automated system for cleaning of large machined components.

BACKGROUND

Cleaning of machined components is required as the components may get soiled or dirty by grease, markings, paint, dirt, dust, and the like especially during manufacture. Such components may require surface cleaning before further manufacturing processes, for example heat treatment, can be done in order to provide optimized finished components.

Currently, the cleaning of large machined components is performed manually. This requires an operator to manually wipe off or clean the component in order to perform dry or wet cleaning. This manual process tends to be time consuming and presents ergonomic and safety issues for the operator like fatigue, cuts due to sharp edges, contact with a strong cleaning agent during the wet cleaning, and the like. Also, the operator may tend to miss cleaning certain parts of the component based on size, geometry and sometimes accessibility of the component. This may affect the overall quality of the cleaning.

Hence, there is a need to provide an improved cleaning technique for large machined components which overcomes the above mentioned shortcomings.

SUMMARY OF THE DISCLOSURE

In one aspect of the present disclosure, a system for cleaning a component of a machine is provided. The system includes a cleaning head having a first reel to store a cloth. The cleaning head also includes a first idler and a second idler placed in a spaced apart arrangement proximate to the first reel. The first idler and the second idler are configured to receive the cloth from the first reel which extends between the first idler and the second idler. A spray nozzle is placed proximate to the cloth, which extends between the first idler and the second idler, to spray a cleaning agent on to the cloth. The second reel is also placed proximate to the first idler and the second idler to store the cloth received from the first idler and the second idler. A robotic arm is attached to the cleaning head to move the cleaning head relative to the component of the machine. A controller is communicably coupled to the cleaning head and the robotic arm and is configured to position the cleaning head relative to the component based on one or more parameters associated with the component. The controller is also configured to activate a movement of the first reel and the second reel to effectuate a dry cleaning cycle and selectively activate the spray nozzle to effectuate a wet cleaning cycle.

In another aspect of the present disclosure, a method for cleaning a component of a machine is provided. The method receives an input signal indicating one or more parameters associated with a component of a machine. The method positions a cleaning head relative to the component based on one or more parameters associated with the component. The method further activates a movement of a first reel and a second reel provided on the cleaning head to effectuate a dry cleaning cycle. In one embodiment, the method selectively activates a spray nozzle provided on the cleaning head to effectuate a wet cleaning cycle.

In another aspect of the present disclosure, a computer based system for cleaning a component of a machine is provided. The computer based system includes a communication interface communicating with a memory. The memory is configured to communicate with a processor. In response to the execution of a computer program, the processor performs functions which include receiving an input signal indicating one or more parameters associated with the component of the machine, positioning a cleaning head relative to the component based on the one or more parameters associated with the component, activating a movement of a first reel and a second reel provided on the cleaning head to effectuate a dry cleaning cycle, and selectively activating a spray nozzle provided on the cleaning head to effectuate a wet cleaning cycle.

Other features and aspects of this disclosure will be apparent from the following description and the accompanying drawings.

DETAILED DESCRIPTION

Figure 1:
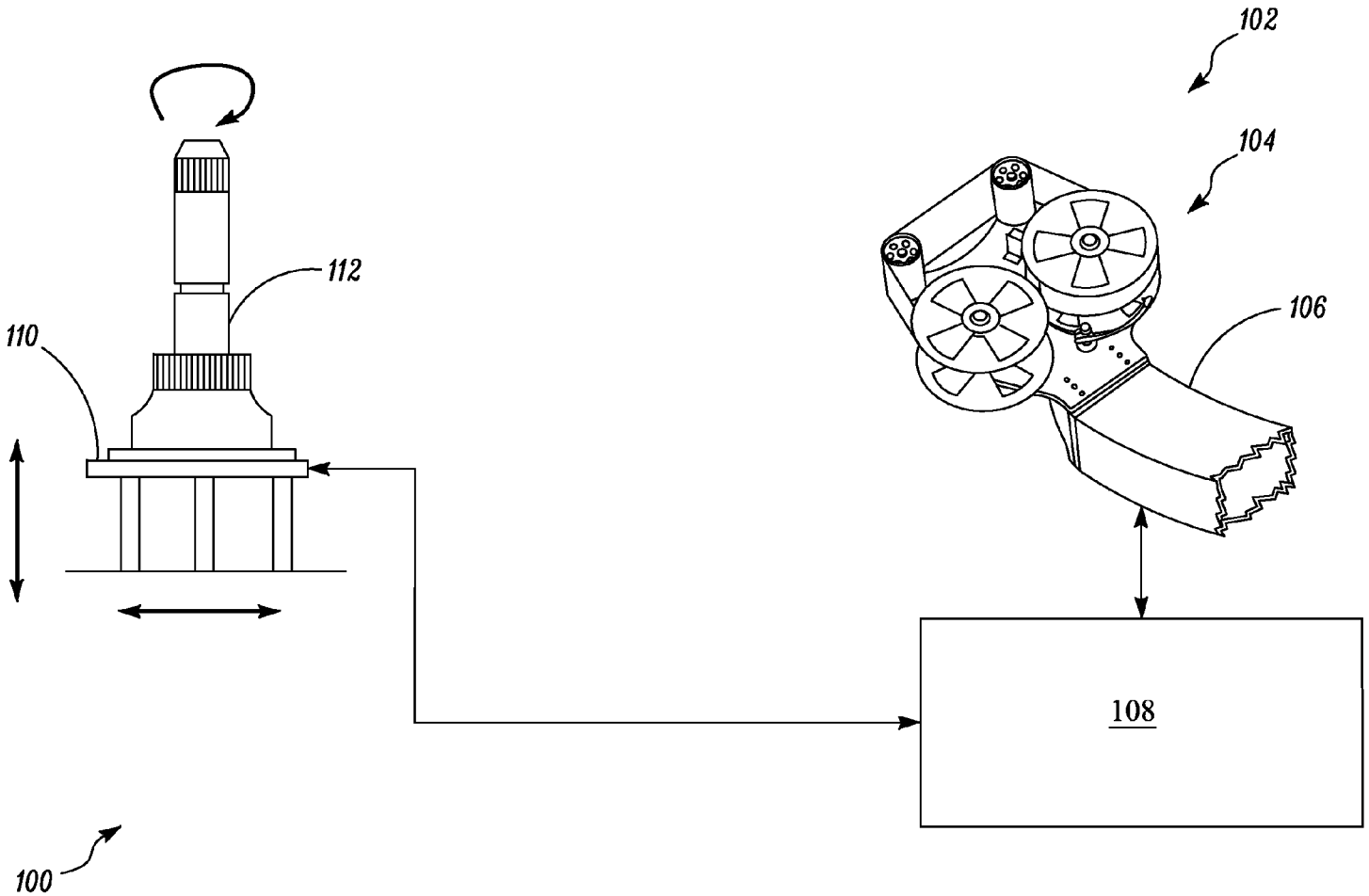
FIG. 1 is a schematic diagram of an exemplary environment, according to one embodiment of the present disclosure.

Wherever possible, the same reference numbers will be used throughout the drawings to refer to the same or like parts. FIG. 1 shows an exemplary environment 100. The exemplary environment 100 includes a cleaning system 102. The cleaning system 102 is an automated system which is configured to clean a machined component 112, such as a spindle as shown, with minimum operator intervention. The cleaning system 102 includes a cleaning head 104, a robotic arm 106 and a controller 108. As shown, the cleaning head 104 is communicably coupled to the robotic arm 106. The robotic arm 106 in turn is communicably coupled to the controller 108. The robotic arm 106 includes various degrees of freedom of movement and is configured to position the cleaning head 104. The movement of the robotic arm 106 is controlled by the controller 108. Further, the controller 108 is also communicably coupled to an external turntable 110. The component 112 that needs to be cleaned is placed on the turntable 110.

The turntable 110 may be placed away from the cleaning system 102 to provide unobstructed access to the component 112 which is placed on the turntable 110. It should be noted that the location of the turntable 110 may be so chosen so as to provide sufficient space around the turntable 110 for the cleaning head 104 to be appropriately positioned in space relative to the component 112. The turntable 110 may be capable of vertical and/or horizontal movement, with or without rotary motion (shown by arrowheads in figure), as per the system design and requirements. To this end, one or more motors, hydraulic and/or pneumatic systems (not shown) may be attached to the turntable 110 in order to facilitate the movement. Alternatively, in one embodiment, the turntable 110 may be stationary. The component 112, more specifically, may include any large machined component, such as, for example, a spindle, a shaft, and the like having a large surface that needs to be cleaned before further manufacturing processes like heat treatment, assembly or packaging. It should be noted that the component 112 to be cleaned need not have any restrictions on shape or type of surface.

The controller 108 is configured to send signals to the robotic arm 106 in order to control the movement of the robotic arm 106 in a three dimensional space near the component 112. This movement of the robotic arm 106 may in turn lead to the positioning of the cleaning head 104 relative to the component 112 in order to effectuate cleaning of the component 112. It should be noted that the elements and the associated connections shown herein are merely on an exemplary basis and can vary as per the system design and requirements.

Figure 2:
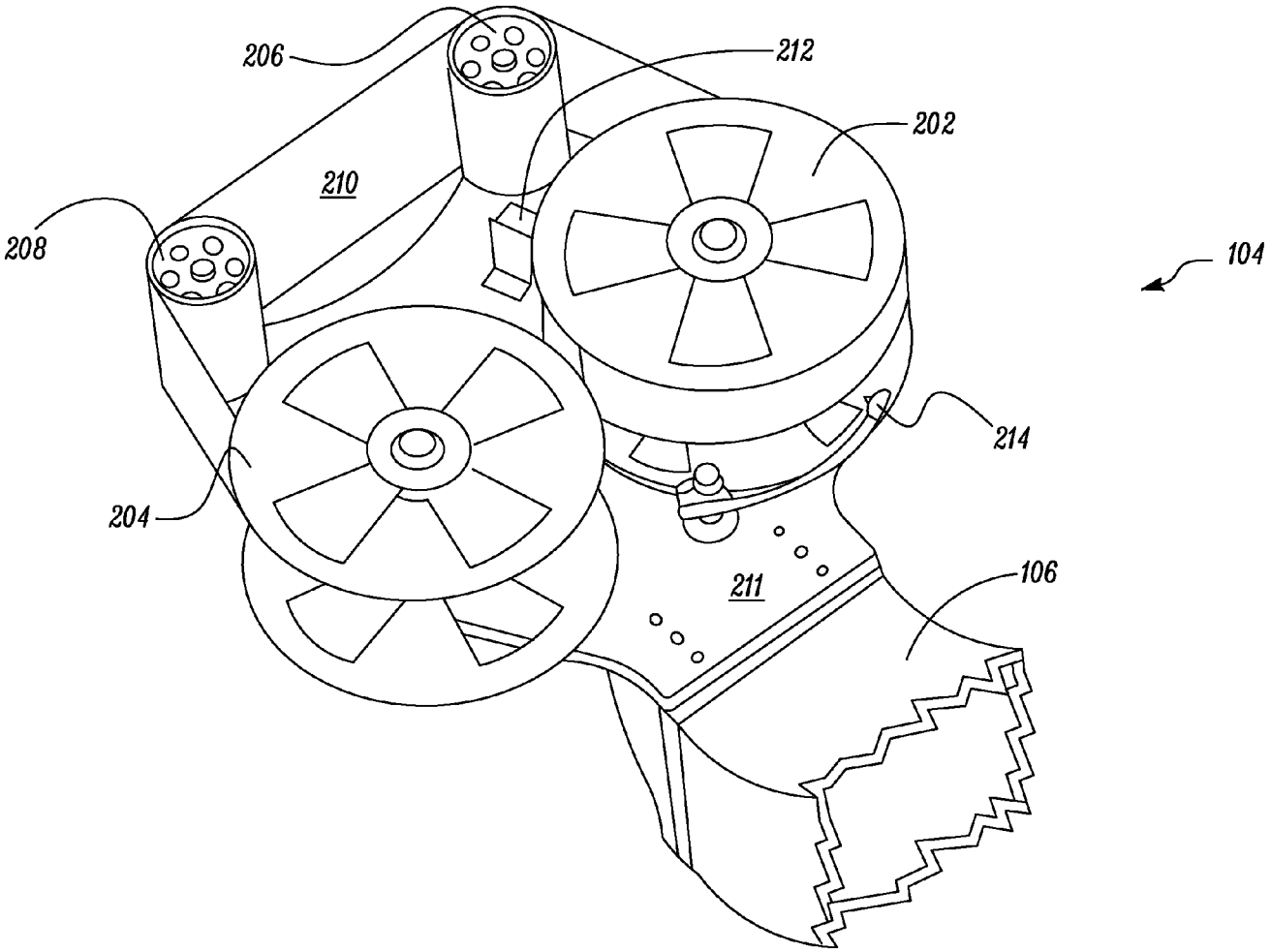
FIG. 2 is a perspective view of a cleaning head.

FIG. 2 is a perspective view of the cleaning head 104. As shown, the cleaning head 104 includes a first reel 202 and a second reel 204 placed in a spaced apart arrangement. The cleaning head also includes a first idler 206 and a second idler 208 placed in a spaced apart arrangement. The first idler 206 and the second idler 208 are placed proximate to the first reel 202 and the second reel 204 respectively. The first and second reels 202, 204 and the first and second idlers 206, 208 are mounted on a base plate 211. Further, the first and second reels 202, 204 and the first and second idlers 206, 208 may be made any suitable material such as, but not limited to, metal, plastic, and the like.

Moreover, size and dimension of the first and second reels 202, 204 and the first and second idlers 206, 208 may also vary. The first reel 202 is configured to store a cloth 210 which is used to clean the component 112. The cloth 210 may be a lint free cloth or any other type of cloth which may be capable of producing the desired quality of cleaning. More specifically, the first reel 202 is configured to store the clean or unused cloth 210. The first and second idlers 206, 208 are configured to receive the cloth 210 from the first reel 202. As shown in FIG. 2, the arrangement of the first and second idlers 206, 208 is such that the cloth 210 extends between the first and second idlers. During cleaning, the extended cloth 210 is brought in contact with the component 112. The second reel 204 is configured to store the cloth 210 after usage.

Figure 4:
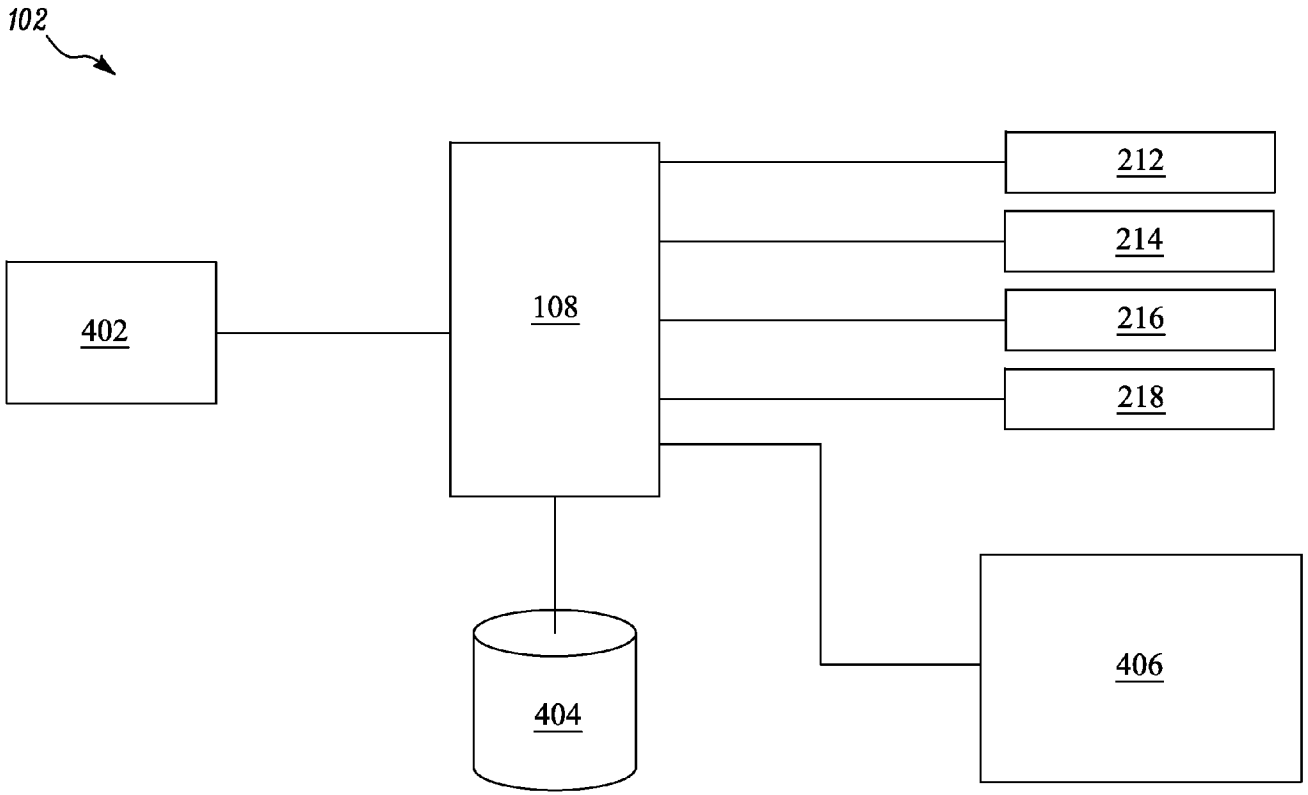
FIG. 4 is a block diagram illustrating a cleaning system.

One of ordinary skill in the art will appreciate that the cleaning head 104 may be connected to one or more motors (not shown) to effectuate the rotation of the first reel 202 and the second reel 204 to facilitate use of the cloth 210. Accordingly, as shown in FIG. 4, the cleaning head 104 may also include a first speed sensor 216 to determine a rate of spin of the first reel 202; and a second speed sensor 218 to determine a rate of spin of the second reel 204. It should be noted that the rate of spin of the first and second reels 202, 204 during the cleaning cycle may be controlled by the controller 108 and will be explained in detail in connection with FIG. 4.

Figure 3:
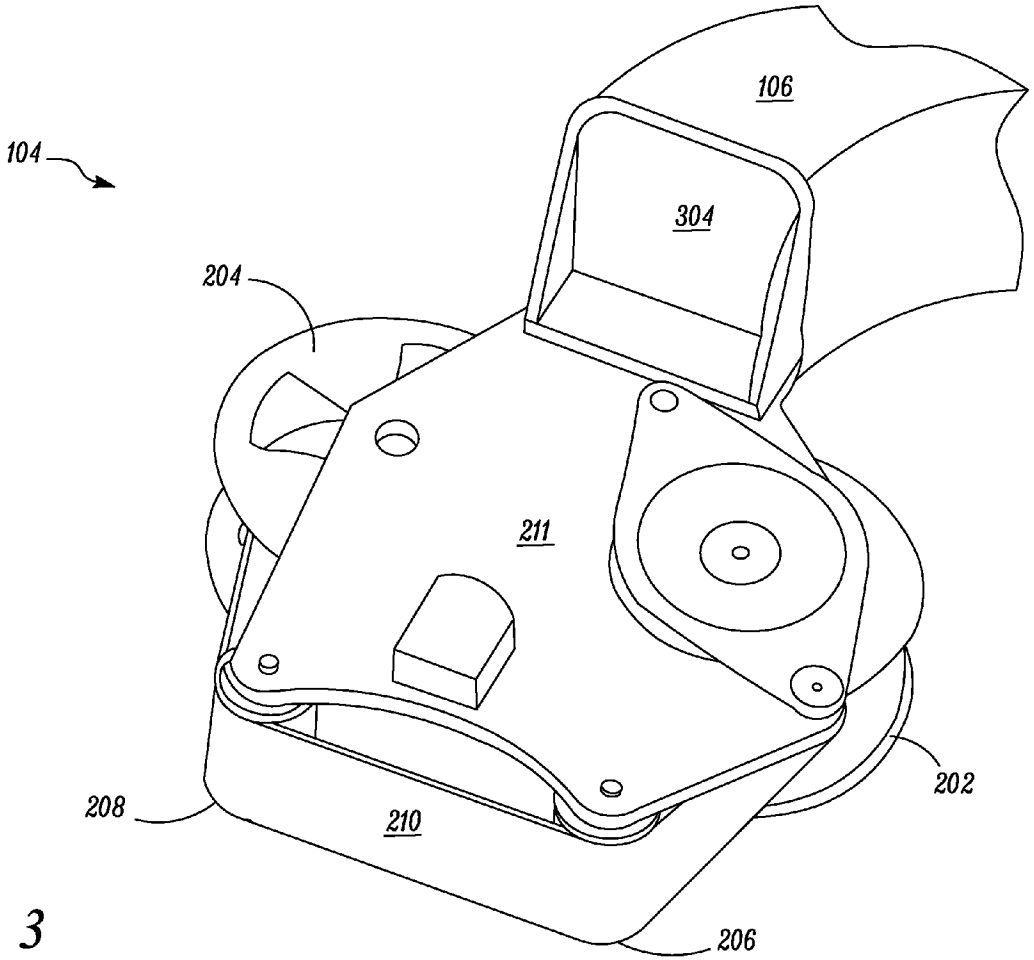
FIG. 3 is a rear perspective view of the cleaning head shown in FIG. 2.

In one embodiment, the cleaning head 104 may include a tension sensor 214 to sense a tension on the cloth 210. The sensed tension may be indicative of any breaks or defects in the cloth 210. It should be noted that the positioning of the sensors shown in accompanying figures is merely exemplary. FIG. 3 depicts a reverse perspective view of the cleaning head 104. As shown, the cloth handling components like the first and second reels 202, 204, and the first and second idlers 206, 208 may be mounted on the base plate 211.

In one embodiment, any of the sensors or other components, more specifically the tension sensor 214, the first speed sensor 216, the second speed sensor 218, the one or more motors (not shown), and the like may be mounted on the base plate 211. A mounting plate 304 may be provided on the base plate 211 to mount the cleaning head 104 on the robotic arm 106. The cleaning head 104 may be mounted on the robotic arm 106 by bolting, welding or any other method known in the art. It should be noted that the components and their mounting location on the base plate 211 of the cleaning head 104 are not limited to that described herein and may vary as per the system design and requirements.

The cleaning head 104 may be used for the dry cleaning of the component 112 in which the cloth 210 is rubbed against the surface of the component 112. Referring to FIG. 2, in one embodiment, a spray nozzle 212 is provided on the cleaning head 104 to effectuate a wet cleaning cycle, as and when required. The spray nozzle 212 may be placed proximate to the extended cloth 210 between the first idler 206 and the second idler 208. The spray nozzle 212 may be used to spray any type of a cleaning agent onto the cloth 210 for wet cleaning of the component 112. The cleaning agent may be a water-based, alcohol-based, detergent-based cleaning agent based on the component 112 material and/or the quality of cleaning desired.

It should be understood that a need for the wet cleaning of the component 112 may be felt especially for the removal of tough stains, grease or dirt from a surface of the component 112. For example, some paint markings may be made on the component 112 for the purpose of identification during some machining process, logistics or the like. In such a case, dry cleaning may not prove effective enough and thus some appropriate paint remover may be used as the cleaning agent to remove the paint markings. This paint remover may be sprayed as the cleaning agent on the cloth 210 to wet it, via the spray nozzle 212. The wet cloth may then be rubbed over the component 112 to perform the desired wet cleaning.

FIG. 4 illustrates a block diagram of the cleaning system 102 and the turntable 112. The controller 108 is communicably connected to a parameter input module 402. The parameter input module 402 may be a human-machine interface or input device through which inputs or instructions may be fed into the controller 108. The parameter input module 402 may employ numerical and/or alphanumerical keyboards, buttons, touchscreens, microphones, and the like or any other input device known in the art.

The operator may provide inputs related to one or more parameters associated with the component 112 via the parameter input module 402. The one more parameters associated with the component 112 may include at least one of a size of the component 112, a shape of the component 112, and a length of the component 112. Alternatively, the operator may provide an input such as a part number associated with the component 112 via the parameter input module 402. These inputs may then be mapped against a predefined dataset in order to identify the one or more parameters associated with the component 112.

The controller may be coupled to a database 404. The database 404 may be configured to store the predefined dataset. In one embodiment, the inputs provided via the parameter input module 402 may also be used to modify the predefined dataset. For example, in case of a new component 112 the operator may enter size related information for storage and later retrieval from the database 404. The database 404 may be an oracle database or any other database known in the art. The database 404 could be extrinsic or intrinsic to the controller 108.

Further, based on the one or more parameters associated with the component 112, the controller 108 may determine a distance and/or direction of movement of the robotic arm 106 in order to position the cleaning head 104 at the appropriate location proximate to the component 112. In one embodiment, the database 404 may additionally contain appropriate mapping of the one or more parameters associated with the component 112 and the corresponding distance or the direction of movement associated with the robotic arm 106. In another embodiment, the movement of the robotic arm 106 may be manually overridden wherein the operator may control the movement of the robotic arm 106 via inputs fed into an operator interface device like a control panel, a remote control, and the like.

Figure 5:
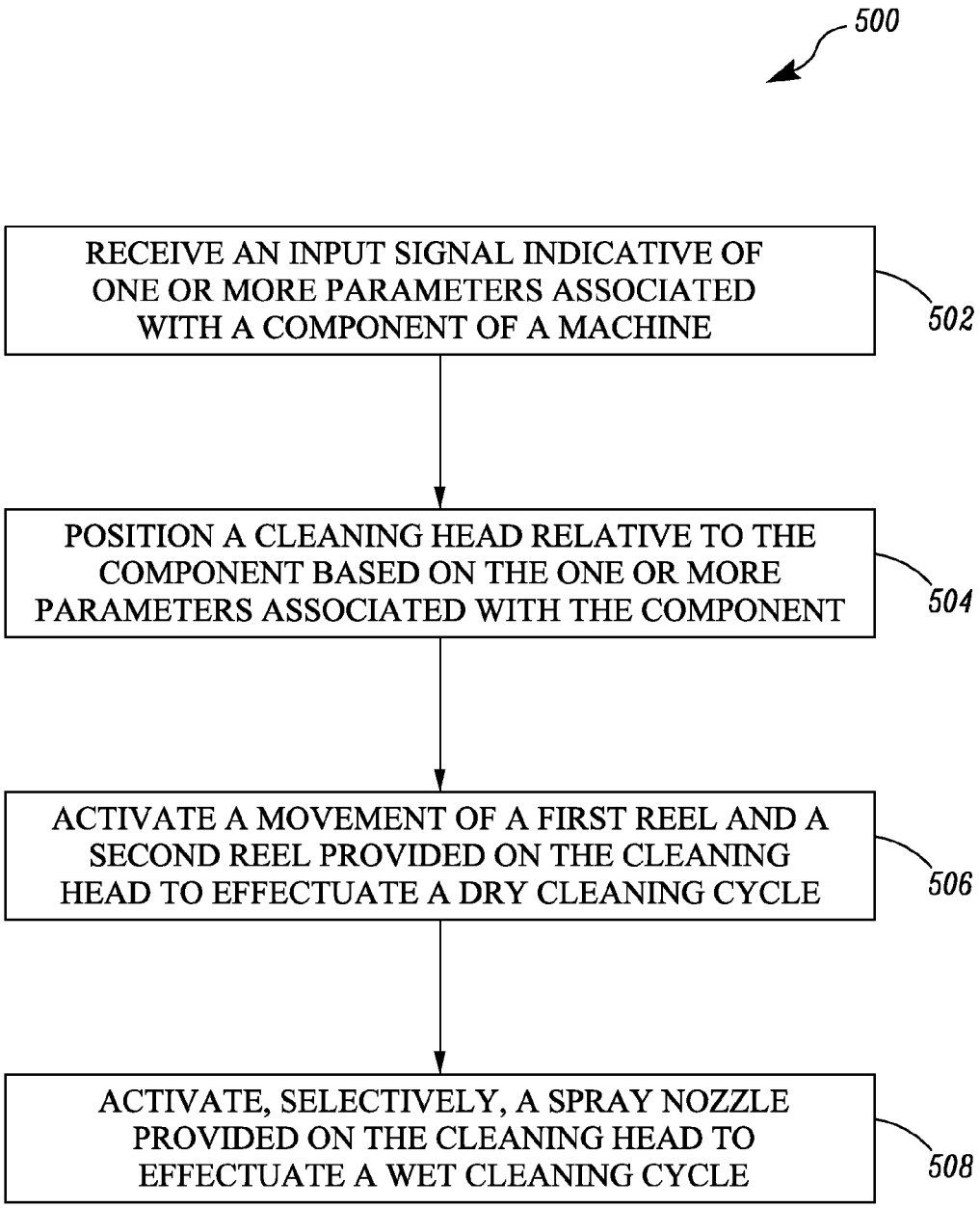
FIG. 5 is a flowchart of a method for cleaning a component of a machine.

After positioning the cleaning head 104, the controller 108 may send signals to the cleaning head 104 to control the dry or wet cleaning of the component 112. Accordingly, the controller 108 may control the rate of spin of the first and second reels 202, 204 based on signals received from the first speed sensor 216 and the second speed sensor 218 respectively. The controller 108 may also determine the defect or break on the cloth 210 based on the signals received from the tension sensor 214. For example, on detecting the defect, the controller 108 may flag an error so that the operator is made aware that the cloth 210 needs to be replaced. In one embodiment, the controller 108 may send control signals to activate or deactivate the spray nozzle 212 during the wet cleaning cycle. The details of the dry and wet cleaning cycle will be described in connection with FIG. 5.

Additionally, as shown in FIG. 4, the controller 108 may be optionally coupled to a turntable control module 406 associated with the turntable 110. The controller 108 may send signals to the turntable control module 406 in order to control the rotation of the turntable 110. A motor (not shown) or any other known actuation mechanism may be attached to the turntable control module 406 to cause the required rotary motion of the turntable 110. A person of ordinary skill in the art will appreciate that the movement of the turntable 110 may enhance accessibility to certain parts of the component 112.

The controller 108 may embody a single microprocessor or multiple microprocessors that include a means for receiving input from the parameter input module 402 and other sensors provided on the cleaning head 104, to effectuate the dry or wet cleaning cycle of the component 112 using the cleaning head 104. Numerous commercially available microprocessors may be configured to perform the functions of the controller 108. It should be appreciated that the controller 108 may readily embody a general machine microprocessor capable of controlling numerous machine functions. A person of ordinary skill in the art will appreciate that the controller 108 may additionally include other components and may also perform other functionality not described herein. Further, the connections and sensors described herein are merely on an exemplary basis and do not limit the scope of the disclosure.

INDUSTRIAL APPLICABILITY

Large machined components 112 require cleaning prior to installation on the machine or further processing such as heat treatment. Accordingly, dry or wet cleaning, or a combination thereof may be required. Currently, the cleaning of large machined components is performed manually. This procedure is labor intensive, time consuming and may not provide desired results. Further, manual cleaning may present ergonomic and safety issues on the part of the operator like fatigue, cuts due to sharp edges, contact with strong cleaning agents and the like.

The present disclosure provides the cleaning system 102 which facilitates automated cleaning of the component 112 with minimum human intervention during the cleaning process. Thus, ergonomic and safety risks of the operator are avoided which include reaching relatively inaccessible parts of the component 112, physical injury due to cuts from sharp edges, contact with strong cleaning agents, and the like. Also, the cleaning system 102 may provide consistent cleaning, reduced cycle time, efficient use of the cleaning agent, and overall improved cleaning of the component 112.

At step 502, an input signal indicative of the one or more parameters associated with the component 112 is received. The controller 108 may receive the input signal from the parameter input module 402. As described above, the input may be indicative of the part number, and/or size and dimensions associated with the component 112. The controller 108 may map the received input with the predefined dataset in order to determine the distance and/or the direction of movement of the robotic arm 106 coupled to the cleaning head 104.

Further, at step 504 the cleaning head 104 is positioned relative to the component 112 based on the one or more parameters associated with the component 112. The controller 108 may appropriately move the robotic arm 106 in order to position the cleaning head 104 at the required location for cleaning the component 112. After positioning the cleaning head 104 as required with respect to the component 112, the controller 108 may send signals to the cleaning head 104 for carrying out the dry or wet cleaning operation.

At step 506 the first reel 202 and the second reel 204 provided on the cleaning head 104 are activated to effectuate the dry cleaning cycle. The controller 108 may send the control signals to the one or more motors attached to the cleaning head 104 for controlling the speed of rotation of the first reel 202 and/or the second reel 204, as desired. The spinning of the first reel 202 may cause the cloth to be taken up by the first and second idlers 206, 208. The cloth 210 may be firmly held in an extended configuration between the first and second idlers 206, 208. The component 112 is in contact with the extended cloth 210. Thereafter, the component 112 may be cleaned by rubbing of the cloth 210 against the surface of the component 112. The used cloth 210 may be taken up by the second reel 204.

The dry cleaning of the component 112 may be conducted in several ways. For example, in one case, the component 112 may be held stationary while the cleaning head 104 may move over the component 112, with the cloth 210 extended between the first and second idlers 206, 208 in contact with the surface of the component 112. Alternatively, the component 112 placed on the turntable 110 may be made to rotate while the cleaning head 104 remains stationary at a fixed position. Further, the cloth 210 is either stationary or may move based on the rotation of the first and second reels 202, 204.

In another case, the component 112 may be made rotate in one direction and the cloth 210 may be made to move in the opposite direction. In one embodiment, velocities of rotation of the component 112 and/or the movement of the cloth 210 are individually controllable by the controller 108. It should be understood that there is a limited quantity of cloth 210 stored in the system, and so the rotation of the component 112 may be relatively faster than the cloth speed.

Also, the controller 108 receive signals from the first speed sensor 216 and the second speed sensor 218 to indicative of the rate of spin of the first reel 202 and the second reel 204, respectively. In one embodiment, the signals received from the first and second speed sensors 216, 218 may be used to control the cloth speed. It should be noted that rotating the first and second reels 202, 204 at a constant RPM results in varying cloth speed as the cloth 210 gets used up. Moreover, based on the received signals the controller 108 may alert the operator if the rate of spin of the first and second reels 202, 204 is not at the intended speed or if the motion has stopped. Optionally, a similar speed sensor (not shown) may be mounted on the turntable 110 to generate a signal indicative of the speed of rotation of the turntable 110. This speed sensor may be coupled to the controller 108 in order to monitor the rotation of the turntable 110 and ascertain the component speed.

Also, the controller 108 may receive the signal indicative of the tension on the extended cloth 210 from the tension sensor 214. Accordingly, the controller 108 may detect a tear or end of the cloth 210 based on the signals received from the tension sensor 214. Moreover, the signal received from the tension sensor 214 may be used to detect presence of the cloth 210. The controller 108 may appropriately notify the operator via display message in case the cloth 210 is torn or the cloth 210 is run out. It should be noted that the signal received from the tension sensor 214 may be used to detect part presence. Hence, based on the received signal, the cleaning head 104 may be moved closer or farther away from the component 112. In another embodiment, adjustment of the cloth speed or component rotation may be based on sensed tension, for instance to avoid tearing the cloth 210.

At step 508 the controller 108 may selectively activate the spray nozzle 212 provided on the cleaning head 104 to effectuate the wet cleaning cycle. The activation of the spray nozzle 212 may be for a short duration with automatic shut-off. Alternatively, the spray nozzle 212 may be deactivated when the controller 108 sends a deactivation signal to the spray nozzle 212. On activation, the spray nozzle 212 may spray the cleaning agent on the cloth 210 for the wet cleaning of the component 112. The cleaning agent may be stored in a tank (not shown) on or proximate to the cleaning head 104. The wet cloth 210 may then move over the component 112 to perform the wet cleaning cycle.

It should be noted that the cleaning head 104 may be used for the dry cleaning of the component 112 or a combination of the dry and wet cleaning of the component 112, as the case may be. For example, in one case, after the cloth 210 is brought in contact with the component 112, the cloth 210 may be sprayed with the cleaning agent, while the component 112 spins beneath the cloth 210. The cleaning agent is applied via the cloth 210 to areas of the component 112 that need to be cleaned. This cleaning process may remove majority of the dirt or contaminants present on the component 112.

Thereafter, the dry cloth 210 may be advanced over the spinning component 112 in order to effectuate the dry cleaning of the component 112. During the dry cleaning, the cleaning agent and any remaining contaminants may be removed from the surface of the component 112. It should be noted that in one embodiment, the robotic arm 106 may move the cleaning head 104 up and down over the component 112 during the dry or wet cleaning cycle since the areas to be cleaned are wider than the cloth 210.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for cleaning a component of a machine, the system comprising:

a cleaning head comprising:

a first reel configured to store a cloth;

a first and second idler placed in a spaced apart arrangement proximate to the first reel, the first and second idler configured to receive the cloth from the first reel, wherein the cloth extends between the first idler and the second idler;

a tension sensor configured to provide a signal indicative of a tension on the cloth extended between the first idler and the second idler;

a spray nozzle placed proximate to the cloth extended between the first idler and the second idler, the spray nozzle configured to spray a cleaning agent onto the cloth; and a second reel placed proximate to the first idler and second idler, the second reel configured to store the cloth received from the first idler and second idler;

a robotic arm attached to the cleaning head, the robotic arm configured to move the cleaning head relative to the component of the machine; and a controller communicably coupled to the cleaning head and the robotic arm, the controller configured to:

position the cleaning head relative to the component based on one or more parameters associated with the component;

activate a movement of the first reel and the second reel to effectuate a dry cleaning cycle; and selectively activate the spray nozzle to effectuate a wet cleaning cycle.

2. The system of claim 1, wherein the controller is further configured to detect a defect in the cloth based on the tension on the cloth extended between the first idler and the second idler.

3. The system of claim 1 further comprising:

a first speed sensor associated with the first reel, the first speed sensor configured to provide a signal indicative of a rate of spin of the first reel; and a second speed sensor associated with the second reel, the second speed sensor configured to provide a signal indicative of a rate of spin of the second reel.

4. The system of claim 3, wherein the controller is further configured to control the rate of spin of the first reel and the second reel.

5. The system of claim 1, wherein the one or more parameters associated with the component comprises at least one of a size of the component, a shape of the component, and a length of the component.

6. The system of claim 1, wherein the controller positions the cleaning head relative to the component of the machine based on a comparison of the one or more parameters associated with the component with a pre-determined dataset.

7. The system of claim 1 further comprising a turntable for placing the component of the machine, wherein the turntable is communicably coupled to the controller.

8. The system of claim 7, wherein the controller is further configured to control a speed of rotation of the turntable.

* * * * *